US008399791B2

(12) United States Patent
Gericke et al.

(10) Patent No.: US 8,399,791 B2
(45) Date of Patent: Mar. 19, 2013

(54) INTERRUPTER ARRANGEMENT HAVING A MOVABLE SWITCHING TUBE

(75) Inventors: Joachim Gericke, Berlin (DE); Ronald Puls, Kleinmachnow (DE)

(73) Assignee: Siemens Aktiengesellschaft, Munich (DE)

( * ) Notice: Subject to any disclaimer, the term of this patent is extended or adjusted under 35 U.S.C. 154(b) by 64 days.

(21) Appl. No.: 12/809,671

(22) PCT Filed: Dec. 3, 2008

(86) PCT No.: PCT/EP2008/066679

§ 371 (c)(1),
(2), (4) Date: Jun. 21, 2010

(87) PCT Pub. No.: WO2009/077329

PCT Pub. Date: Jun. 25, 2009

(65) Prior Publication Data

US 2010/0270268 A1 Oct. 28, 2010

(30) Foreign Application Priority Data

Dec. 19, 2007 (DE) ..... 10 2007 063 424

(51) Int. Cl.
*H01H 33/53* (2006.01)

(52) U.S. Cl. ..... 218/66; 218/59; 218/43

(58) Field of Classification Search ..... 218/51, 218/59, 66, 43
See application file for complete search history.

(56) References Cited

U.S. PATENT DOCUMENTS

| | | | | |
|---|---|---|---|---|
| 4,598,188 | A * | 7/1986 | Schotzau et al. | 218/59 |
| 5,025,118 | A | 6/1991 | Meinherz et al. | |
| 5,814,781 | A | 9/1998 | Koyanagi et al. | |
| 6,730,871 | B1 * | 5/2004 | Loebner | 218/66 |
| 7,732,727 | B2 * | 6/2010 | Saxl et al. | 218/51 |
| 7,816,618 | B2 * | 10/2010 | Uchii | 218/43 |
| 2004/0256361 | A1 | 12/2004 | Nowakowski | |

FOREIGN PATENT DOCUMENTS

| | | | |
|---|---|---|---|
| CN | 1134596 | A | 10/1996 |
| DE | 3904146 | A1 | 8/1990 |
| DE | 9309667 | U1 | 9/1993 |
| DE | 19517580 | A1 | 11/1996 |
| DE | 20015563 | U1 | 1/2002 |
| DE | 10156535 | C1 | 6/2003 |
| FR | 2760890 | A1 | 9/1998 |
| RU | 2293393 | C2 | 2/2007 |

* cited by examiner

*Primary Examiner* — Truc Nguyen
(74) *Attorney, Agent, or Firm* — Laurence A. Greenberg; Werner H. Stemer; Ralph E. Locher

(57) ABSTRACT

The invention relates to an interrupter arrangement (1) having a switching tube (3) comprising a switch gas outlet opening (5). The switching tube (3) is connected to a coupling section (9) of a drive rod (10) in the region of the switch gas outlet opening (5). The coupling section (9) is protected from switch gasses emitted from the switch gas outlet opening (5) by means of a shield (15).

16 Claims, 3 Drawing Sheets

INTERRUPTER ARRANGEMENT HAVING A MOVABLE SWITCHING TUBE

BACKGROUND OF THE INVENTION

Field of the Invention

The invention relates to an interrupter arrangement having a movable switching tube and having a coupling section of a drive rod, which coupling section is coupled to the switching tube in the area of a switching gas outlet opening of the switching tube.

One such interrupter arrangement is disclosed, for example, in French Laid-Open Specification FR 2 760 890 A1. This document describes an interrupter arrangement which has a movable switching tube to which a coupling section of a drive rod is coupled. The coupling section is located in the area of a switching gas outlet opening of the switching tube. In the known embodiment variant, the coupling section is designed such that it tapers in the direction of the switching gas outlet opening. In order to ensure an adequate life, the coupling section can be designed to have appropriate resistance to the switching gases, which in some cases are hot and aggressive.

A configuration with such resistance in this case means using designs which are appropriately solid and are therefore heavy. As the power-handling capability of the interrupter arrangement rises, ever more complex movements must be transmitted via the drive rod to the switching tube. In particular, the switching tube is required to have relatively high acceleration. For this purpose, the appropriate drive devices, by means of which the drive rod and the switching tube are moved, must be designed for higher power levels.

Higher power levels are achieved by more powerful drive devices, which consume more power.

BRIEF SUMMARY OF THE INVENTION

The object of the invention is therefore to specify an interrupter arrangement which can carry out relatively complex movements of the switching tube, with the drive device consuming a reasonable amount of power.

According to the invention, in the case of an interrupter arrangement of the type mentioned initially, this is achieved in that the coupling section is protected against switching gas by a shield.

The provision of a shield on the coupling section makes it possible to protect the coupling section against direct influences of switching gases. On the one hand, the shield can be used to divert the switching gases from the coupling section. However, it is also possible to provide for the shield to actively contribute to cooling of the switching gases. To do this, it is possible, for example, for the shield to assist particular guidance/swirling of the switching gases, or for the shield to separate particles which cool the switching gas.

By way of example, the coupling section may be part of a drive rod. However, it is also possible for the coupling section to be in the form of a separate component, which allows the drive rod and switching tube to be connected. The guidance and cooling of the switching gas makes it possible to design the coupling section in a filigree manner. For example, lighter-weight designs can thus be used whose structure would be at risk, at least over the long term, as a result of the influence of the switching gases, if there were no shield effect. The use of lighter-weight designs, generally based on low-density materials, makes it possible to reduce the moving mass of the kinematic system. It is thus possible to move the switching tube more easily while maintaining or reducing the drive power to be applied by a drive device. The easier movement capability can lead on the one hand to the capability for more exact control, for example for more exact acceleration of the switching tube. On the other hand, an improved movement capability can also make it possible to further increase the maximum speed at which the switching tube can move.

An improved capability to move the switching tube makes it possible to cope with higher disconnection currents by means of the switching arrangement. By way of example, a switching arrangement which is used to connect and disconnect current paths in electrical power transmission systems can typically be used in a high-voltage circuit breaker. For this purpose, the movable switching tube is provided at its end that is remote from the coupling section with a switching contact piece which is movable relative to an opposing contact piece and can make a conductive connection to it, in order to form a current path, and can be moved away from the opposing contact piece, in order to interrupt a current path.

Particularly when a current path is interrupted, arcs may be created which expand media that are located in the area of the contact pieces to form a switching gas, with at least some of this switching gas being transported through the switching tube in the direction of the switching gas outlet opening, where it strikes against the shield of the coupling section.

A further advantageous refinement makes it possible to provide for the shield to be mounted on the coupling section.

Mounting the shield on the coupling section makes it possible to maintain the relative position with respect to the coupling section, irrespective of the progress of a movement of the switching tube or of the coupling section. It is thus possible to limit the spatial extent of the shield, with the coupling section being adequately protected by the shield. It is advantageous to reduce the volume of the shield, in order to keep the masses that have to be moved within the kinematic system small.

It is also advantageously possible to provide for the shield to be aligned essentially transversely with respect to the switching tube axis.

The outlet opening of a switching tube is advantageously designed such that the switching gas can as far as possible flow out in the direction of the switching tube axis. In the case of a shield which is aligned transversely with respect to the switching tube axis, the protection area of the shield extends essentially axially behind the shield. This results in a shield protection area in which the shield can on the one hand advantageously divert the switching gas, and can on the other hand swirl it and cool it during this diversion. The coupling section can then extend within the protection area. This makes it possible to introduce the forces required to drive the switching tube into the switching tube as far as possible in the direction of the tube axis, via the coupling section. This makes it possible to use a simple design for the switching tube, in addition to a lightweight design of the coupling section. Switching movements are introduced approximately linearly into the switching tube via the coupling section. This allows movements to be transmitted with virtually no twisting and tilting, with comparatively low-mass designs.

Furthermore, it is advantageously possible to provide for the shield to be movable relative to the switching tube.

Movable mounting the shield allows the shield to have a limited amount of play. By way of example, this makes it possible to react to suddenly occurring switching gas flows. In this case, the shield is subject to a certain amount of movement, and can react flexibly to the switching gas flow. Furthermore, relative movement between the shield and the switching tube makes it possible to decouple any twisting or stressing which may occur in the kinematic chain. In this case, the shield effect of the shield with respect to the coupling section is maintained.

It is advantageously possible to provide for the shield to have an essentially shroud-like structure.

By way of example, a shroud-like structure is formed by placing a dome over a base area of the shield, for example a circular base area. The dome can in this case be provided with appropriate apertures, in order to allow the coupling section to be arranged behind the dome to be connected to the switching tube through the shield. In addition to spherically curved shroud-like structures, it is also possible to form, for example, an essentially hollow-cylindrical section above a base area of the shield, with a conically tapering structure covering the essentially hollow-cylindrical section at that end of the essentially hollow-cylindrical section which is remote from the base area. This results in a stretched, shroud-like structure. At least parts of the coupling section can now extend within the shroud-like structure. The shroud-like structure allows a shield to be designed which provides a protection area both in the axial direction and in the radial direction, with respect to the tube axis of the switching tube and the movement direction of the coupling section.

It is advantageously also possible to provide for the coupling section to be connected movably to the switching tube by means of a connecting element, wherein the connecting element positions the shield on the coupling section.

The coupling section and the switching tube represent mutually different assemblies, which are detachably connected to one another. In order to connect the coupling section to the switching tube, a connecting element can be provided which, for example, is in the form of a bolt, in the form of a hook, like a screw, or has some other suitable shape. Movable connection of the switching tube and coupling section allows the kinematic chain to decouple twists, torsion forces and the like, which can occur when a drive movement is being transmitted from a drive device via a kinematic chain to the switching tube, in order to keep the switching tube as free as possible of any influence from external forces.

By way of example, it is advantageously possible to provide for the coupling section to have a recess which a bolt passes through and which engages in a drive opening in a mirror-image drive element of the switching tube. This results in a connection between the switching tube and the coupling section via the connecting element. By way of example, this connecting element can also engage in the shield, and can fix the shield in its position on the connecting element. The connecting element, which is required to connect the coupling section and the switching tube, is therefore used in a simple manner in addition for positioning the shield on the coupling section. There is therefore no longer any need for additional attachment or holding elements. This allows the moving mass of the kinematic chain to be limited.

It is advantageously possible to provide for a surface of the shield which is subject to the switching gas to be formed at least partially from plastic.

Plastics are particularly suitable for emitting gases under the influence of thermal energy. Gases such as these are referred to as hard gases since they are released from the plastic, in which case the structure of the plastic is changed, at least one its surface. In addition to swirling, the switching gases can be actively cooled by cooling gas emitted in this way. For example, it is advantageous for individual surfaces to be covered with replaceable plastic elements. However, it is also possible for the shield to be formed, for example, exclusively from a plastic, in the form of a plastic injection-molded part. This has the advantage that the mass of the shield is low, in which case large parts of the surface of the shield can be used to emit cooling hard gases. In this case, the shield can be manufactured as a separate component, independently of the coupling section. However, it is also possible for the shield to be formed by a corresponding coating on the coupling section. In these cases, the coupling section and the shield form a composite body.

It is advantageously possible for the coupling section to be formed at least partially from a metal.

The use of a metal as the coupling section makes it possible to also transmit suddenly occurring forces reliably to the switching tube. The switching tube is provided with an electrical switching contact piece at its end remote from the coupling section, and is likewise advantageously formed from a metal, in order to conduct an electric current to the switching contact piece. This makes it possible to introduce large forces for driving the switching tube into the switching tube via the coupling section. The use of a shield makes it possible to protect the coupling section against hot switching gases. It is thus possible to use metals which have a low melting point and a low density. This reduces the mass in comparison to a conventional coupling section, thus allowing more complex and/or faster movements to be transmitted to the switching tube. In particular, non-ferrous metals can be used as the metal, such as aluminum, copper and alloys such as bronzes, in particular such as aluminum compounds. The shield reduces melting and erosion of the coupling section. It is thus possible to use lightweight designs with metals with low melting points for the coupling section and/or the switching rod.

It is advantageously also possible for the shield to be placed like a shroud on the coupling section, and to rest on the coupling section at that end of the coupling section which faces the switching tube.

When the shield has a shroud-like configuration, it is advantageous for the shroud to merge smoothly with the shape of the coupling section and to sheath the coupling section in the outlet-flow direction of the switching gases. In this case, it is advantageous for the shield to rest on the coupling section on that end of the coupling section which faces the switching tube. It is therefore possible to center the shield on the coupling section and to ensure a uniform protective effect on all sides of it.

Furthermore, in this case, it is advantageously possible to provide that a widening joint gap extends between the coupling section and the shield, starting from that end of the coupling section which faces the switching tube.

On the one hand, the shield can be centered by resting on an end face of the coupling section, facing the switching tube. On the other hand, the shield can be positioned relative to the coupling section via this contact point, for example with the assistance of the connecting element. A joint gap which exists between the coupling section and the shield can then widen as continuously as possible thus, for example, creating a circumferential gap like a funnel, with the gap width increasing in the direction of the wider end of the funnel. This makes it possible to give the shield a certain amount of flexibility and mobility, thus making it possible, for example, to compensate for temperature fluctuations, mechanical shocks, etc., without this resulting in immediate destruction of the shield or coupling section.

The invention will be described in more detail in the following text, and is illustrated schematically in a drawing, in which, in this case:

DESCRIPTION OF THE INVENTION

Figure 1:
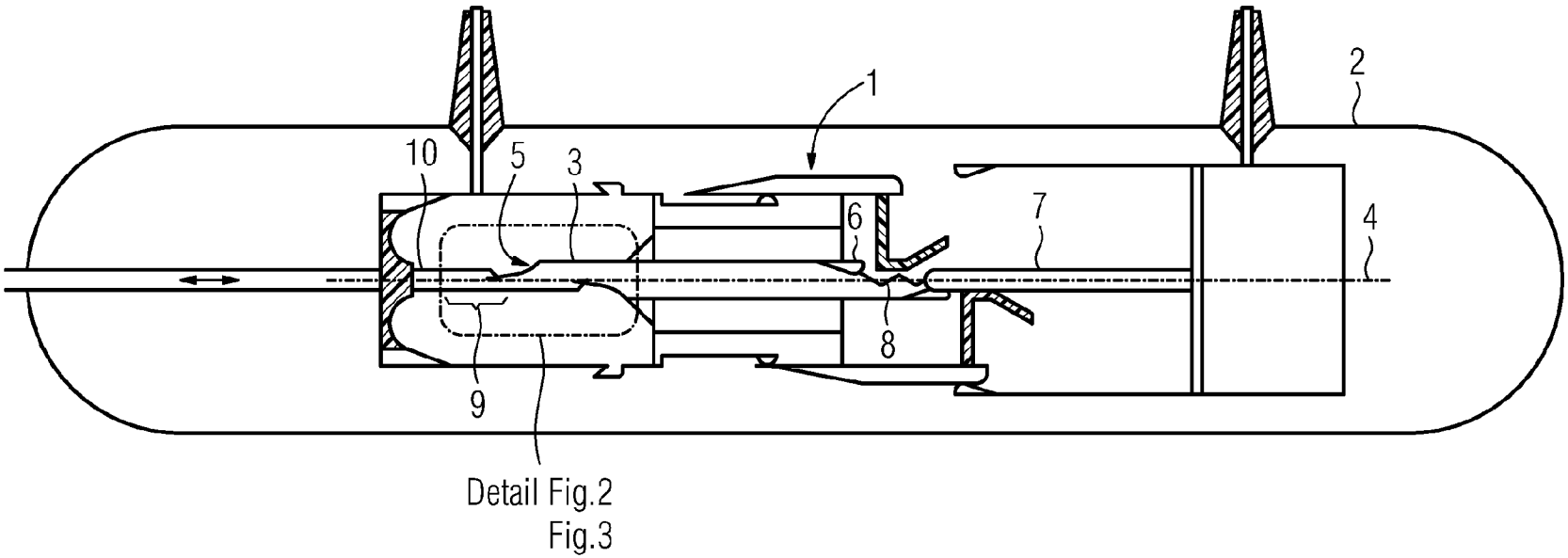
FIG. 1 shows a section through an interrupter arrangement.

FIG. 1 shows a section though an electrical switching device. The electrical switching device has an interrupter arrangement 1 which is arranged within a gas-tight encapsulating housing 2. By way of example, the gas-tight encapsulating housing 2 is an electrically conductive structure, which is connected to ground potential. However, it is also possible for the gas-tight encapsulating housing 2 to be in the form of an electrically insulating arrangement, for example composed of porcelain covers. The interior of the gas-tight encapsulating housing 2 is filled with an electrically insulating gas, for example nitrogen or sulfur hexafluoride. This electrically insulating gas is preferably at a higher pressure than the area surrounding the gas-tight encapsulating housing 2. The electrically insulating gas is used on the one hand for electrical insulation of the interrupter arrangement 1, while on the other hand the electrically insulating gas is also used to assist interruption/quenching of an arc which may occur during a switching process.

Figure 2:
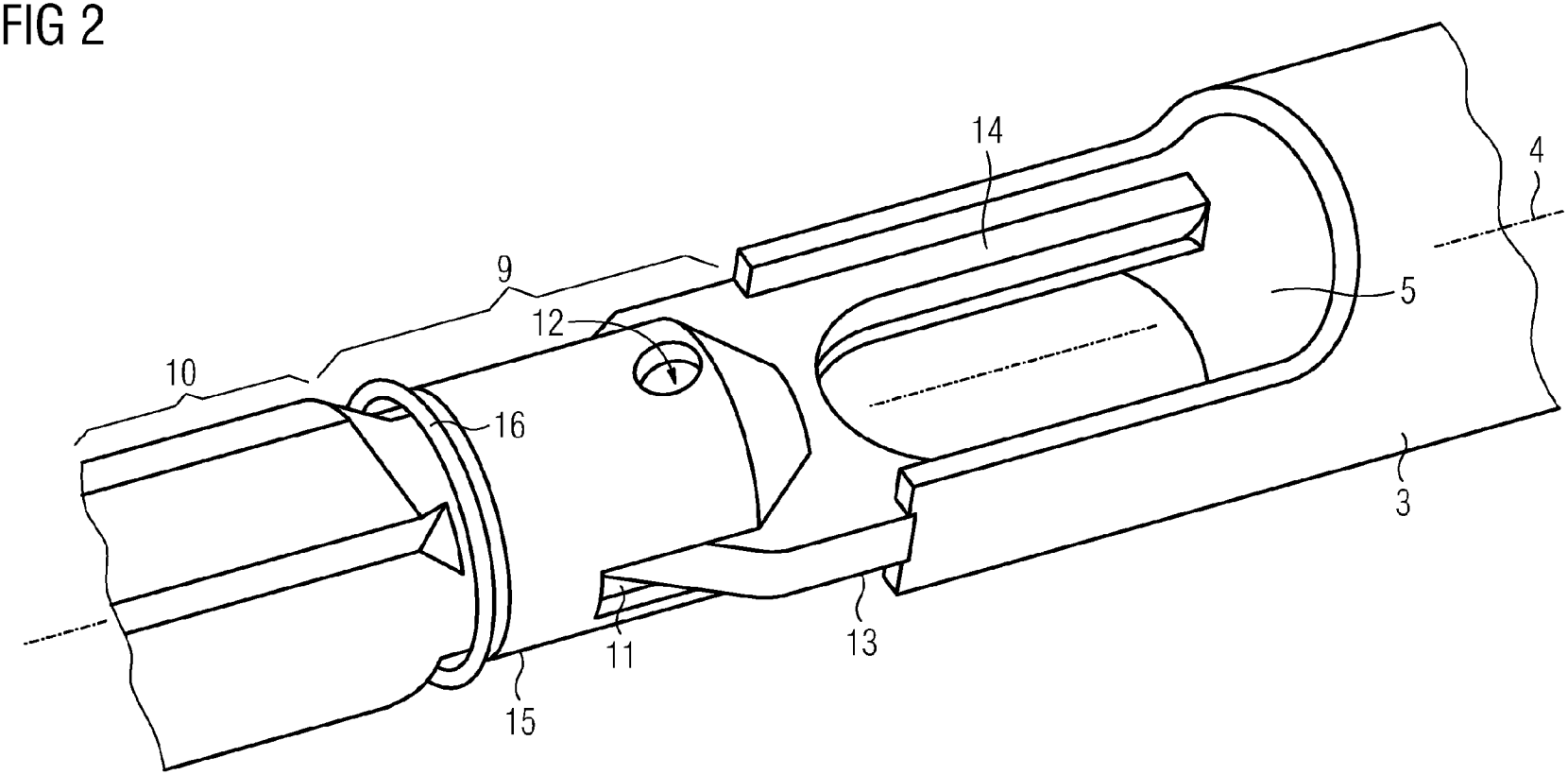
FIG. 2 shows a perspective view of a switching tube, of a shield and of a coupling section.
Figure 3:
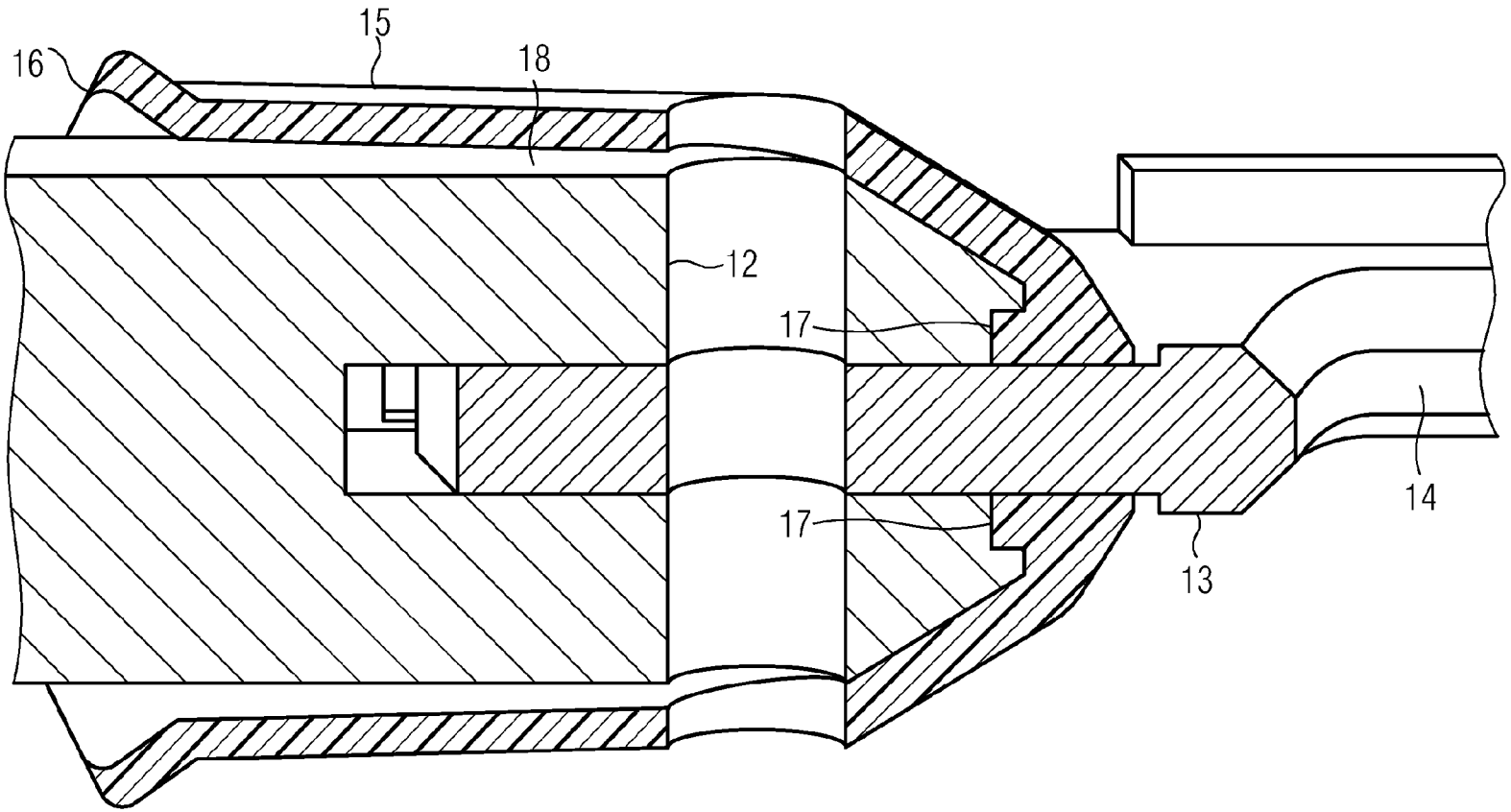
FIG. 3 shows a section through the coupling section of the shield.

The interrupter arrangement 1 has a movable switching tube 3. The tube axis of the switching tube 3 is aligned coaxially with a longitudinal axis 4 of the interrupter arrangement 1. At its end remote from a switching gap in the interrupter arrangement 1, the switching tube 3 has a switching gas outlet opening 5. At its end remote from the switching gas outlet opening 5, the switching tube 3 has a switching contact piece 6. Together with an opposing contact piece 7, the switching contact piece 6 forms a switching gap in the interrupter arrangement 1. The switching contact piece 6 and the opposing contact piece 7 are movable relative to one another. Above the longitudinal axis 4, FIG. 1 shows the disconnected position of the interrupter arrangement 1, and under the longitudinal axis 4 it shows the connected position of the interrupter arrangement 1. As can also be seen in FIG. 1, an arc 8 has been struck between the switching contact piece 6 and the opposing contact piece 7. The arc 8 can occur when a current path between the switching contact piece 6 and the opposing contact piece 7 is interrupted. The arc 8 expands insulating gas which is located in the area of the switching contact piece 6, and produces switching gas. This switching gas is transported through the switching tube 3 in the direction of the switching gas outlet opening 5. This transport is forced to occur, for example, by a pressure difference in the area of the switching gap and in the area of the switching gas outlet opening 5. In addition, a flow can be assisted by mechanical means such as pumps or the like. The switching gas emerges in the area of the switching gas outlet opening 5. The switching tube 3 is coupled in the area of the switching gas outlet opening 5 to a coupling section 9 of a drive rod 10. In this case, the coupling section 9 may be an integral component of the drive rod 10, or the coupling section 9 may represent an intermediate assembly between the drive rod 10 and the switching tube 3. FIGS. 2 and 3 show further refinements relating to the coupling section 9.

FIG. 2 shows a coupling section 9 which is an integral component of a drive rod 10. The coupling section 9 is that section which is protected by a shield 15. In the present case, the drive rod 10 is manufactured from an electrically conductive material, for example a metal such as aluminum. For this purpose, the drive rod 10 has a rectangular cross-sectional profile which is provided with corresponding grooves, thus reducing the mass of the drive rod 10 without disadvantageously influencing the mechanical stiffness of the drive rod 10. At the end of the switching rod 10 facing the switching gas outlet opening 5 of the switching tube 3, the switching rod 10 is equipped with a coupling section 9. In the present exemplary embodiment, the coupling section 9 is an integral component of the drive rod 10. As stated above, it is, however, also possible for the coupling section 9 and the switching rod 10 to represent separate assemblies. For example, this can be done when the drive rod 10 and the coupling section 9 are intended to be manufactured from different types of materials. For example, it is possible for the drive rod 10 to be in the form of an electrically insulating element, and for the coupling section 9 to be electrically conductive.

In the present exemplary embodiment, the coupling section 9 is essentially rotationally symmetrical with respect to the longitudinal axis 4. In this case, the coupling section 9 has a cylindrical shaft and tapers conically at its end which points in the direction of the switching gas outlet opening 5 of the switching tube 3 (cf. FIG. 3). The switching tube 3 and the drive rod 10 are movable with the coupling section 9 in the direction of the longitudinal axis 4 (cf. the double-headed arrow in FIG. 1). The coupling section 9 is provided with a slot-like recess 11. A recess like a hole passes through the coupling section 9 in the area of the slot-like recess 11 and extends on both sides of the slot-like recess 11. By way of example, a bolt which acts as a connecting element can be inserted into this recess 12 which is like a hole. A lug 13, which acts as a drive element, of the switching tube 3 can be fixed by means of the bolt within the slot-like recess 11. The lug 13 likewise has a recess like a hole, through which the bolt passes in the assembled state. The coupling section 9 and the switching tube 3 are connected to one another via the bolt, the slot-like recess 11 and the lug 13 which is bolted in the slot-like recess 11, as a result of which movements can be transmitted from the drive rod 10 by means of the coupling section 9 to the switching tube 3. The dimensions of the bolt, lug 13 and slot-like recess 11 are in this case chosen such that a pivoting movement can take place about the bolt between the switching tube 3 and the drive rod 10.

The lug 13 is fixed within the switching gas outlet opening 5 by two tongues 14 which are aligned parallel to one another. For this purpose, by way of example, the lug 13 can be connected to the switching tube 3 by means of an integral attachment process.

The coupling section 9 is covered with a shield 15 for protection against switching gases emerging from the switching gas outlet opening 5. The shield 15 adopts the shape of the coupling section 9, and surrounds it at the end and on the casing side in the form of a covering. In this case, a slot-like recess, which corresponds to the slot-like recess 11 in the coupling section 9, is provided in the shield 15, in order to hold the lug 13. A recess which is like a hole and matches the recess 12 that is like a hole in the coupling section 9 is likewise arranged in the shield 15. The shield 15 is mounted on the coupling section 9, and is secured in position on the coupling section 9 via the bolt which can be inserted into the recess 12 which is like a hole.

The shield 15 tapers at its end facing in the direction of the switching tube 3. This tapering end merges into an essentially hollow-cylindrical section, which widens radially at its free end, in the form of a widened area like a deflector 16. The deflector 16 bounds a circular base area of the shroud-like shield 15.

FIG. 3 shows the structure and design of the coupling section 9 and of the shield 15 in more detail. The figure shows that the shield 15 has a shroud-like structure, with those sections of the tapering area of the shield 15 which extend on both sides of the slot-like recess 11 engaging in an interlocking manner in recesses 17 in the coupling section 9. In this case, the shield 15 is shaped such that the shield 15 rests on the coupling section 9 with as little gap as possible in the area of areas of the coupling section 9 which are covered at the end. The joint gap 18 which is formed between the coupling section 9 and the shield 15 is in particular in the form of a joint gap 18 which widens continuously, in particular in the area of the essentially cylindrical area of the coupling section 9. On the rearward area of the shield 15, this joint gap 18 runs to the annular circumferential deflector 16, such that the deflector 16 has approximately the same wall thickness as the essentially hollow-cylindrical, slightly conically widening, sections of the shield 15. As can be seen, the coupling section 9 of the drive rod 10 is surrounded like a covering by the shield 15. When the shield 15 is configured like a covering, assemblies located in the protection area of the shield 15 are protected against the direct influence of switching gases. The protective effect of the shield 15 can be extended by means of the integrally formed deflector 16 to areas of the drive rod 10 located behind the coupling section 9.

In order to design the shield 15 to have a mass which is as low as possible, provision is made in the present case for the shield 15 to be manufactured as an injection-molded body or sintered body composed of a plastic, and to be placed on the coupling section 9 like a cover. By way of example, polytetrafluoroethylene or other organic plastics which are suitable for emitting hard gas may be used as the plastic. When using plastics which intrinsically have a certain amount of elasticity and when a widening joint gap 18 is provided, the shield 15 can oscillate such that, for example, there is no need to be concerned about volumetric changes or oscillations caused by thermal differences resulting in immediate destruction as a result of the occurrence of internal material stresses.

The invention claimed is:

1. An interrupter configuration, comprising:

a movable switching tube having a switching gas outlet opening;

a coupling section of a drive rod coupled to said switching tube in an area of said switching gas outlet opening of said switching tube; and a shield disposed to protect said coupling section of the drive rod against switching gas.

2. The interrupter configuration according to claim 1, wherein said shield is mounted on said coupling section.

3. The interrupter configuration according to claim 1, wherein said switching tube has a switching tube axis and said shield is aligned substantially transversely with respect to said switching tube axis.

4. The interrupter configuration according to claim 1, wherein said shield is movably mounted relative to said switching tube.

5. The interrupter configuration according to claim 1, wherein said shield has a structure substantially of a shroud.

6. The interrupter configuration according to claim 1, which comprises a connecting element movably connecting said coupling section to said switching tube, and positioning said shield on said coupling section.

7. The interrupter configuration according to claim 1, wherein a surface of said shield that is to be exposed to the switching gas is formed at least partially from plastic.

8. The interrupter configuration according to claim 7, wherein said coupling section is at least partially formed of a metal.

9. The interrupter configuration according to claim 1, wherein said coupling section is at least partially formed of a metal.

10. The interrupter configuration according to claim 1, wherein said shield is placed on said coupling section in the form of a shroud and said shield rests on an end of said coupling section facing toward said switching tube.

11. The interrupter configuration according to claim 1, wherein said coupling section and said shield define a joint gap therebetween, said joint gap widening from an end of said coupling section facing towards said switching tube.

12. The interrupter configuration according to claim 1, wherein said shield is mounted in a fixed position on said coupling section.

13. The interrupter configuration according to claim 1, wherein said shield is mounted on said coupling section and said shield covers an end face of said coupling section facing toward said switching tube.

14. The interrupter configuration according to claim 1, wherein said shield is mounted on said coupling section and said shield has a tapered end facing toward said switching tube.

15. An interrupter configuration, comprising:

a movable switching tube having a switching gas outlet opening;

a coupling section of a drive rod coupled to said switching tube in an area of said switching gas outlet opening of said switching tube; and a shield disposed and constructed for protecting said coupling section of the drive rod from switching gas emerging from said outlet opening.

16. An interrupter configuration, comprising:

a movable switching tube having a switching gas outlet opening;

a drive rod having a coupling section with a coupling fixing said drive rod to said switching tube in an area of said switching gas outlet opening; and a shield disposed at said coupling section and surrounding said coupling for protecting said coupling from switching gas emerging from said outlet opening.

* * * * *